US006260536B1

(12) United States Patent
Watanabe et al.

(10) Patent No.: US 6,260,536 B1
(45) Date of Patent: Jul. 17, 2001

(54) INTAKE PASSAGE DEVICE FOR AN INTERNAL COMBUSTION ENGINE

(75) Inventors: Mitsunori Watanabe; Hiroshi Kubota, both of Shizuoka-ken (JP)

(73) Assignee: Fuji Robin Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 09/428,478

(22) Filed: Oct. 28, 1999

(30) Foreign Application Priority Data

Nov. 4, 1998 (JP) ..... 10-313603

(51) Int. Cl.[7] ..... F02B 75/02
(52) U.S. Cl. ..... 123/317; 123/184.46
(58) Field of Search ..... 123/591, 184.46, 123/DIG. 5, 317

(56) References Cited

U.S. PATENT DOCUMENTS 4,375,801 * 3/1983 Eckman ..... 123/590
5,386,145 * 1/1995 Boswell ..... 261/41.1
5,572,979 * 11/1996 Czadzeck ..... 123/568
5,662,077 * 9/1997 Boswell ..... 123/184.21
6,065,459 * 5/2000 Stevens ..... 123/590

* cited by examiner

*Primary Examiner*—Tony M. Angenbright
*Assistant Examiner*—Katrina B. Harris
(74) *Attorney, Agent, or Firm*—Arent Fox Kintner Plotkin & Kahn, PLLC

(57) ABSTRACT

An intake passage device is provided for an internal combustion engine having carburetor communicated with a connecting projection of an intake port of a cylinder of the engine, wherein the diameter of the connecting projection becomes smaller toward the inside of the intake port. A connecting pipe is provided for communicating the carburetor with the intake port. An inner end of the connecting pipe is engaged in the connecting projection. There is formed a plurality of one communication passages formed in the connecting pipe for communicating an inside of the connecting pipe with a space between an inside wall of the connecting projection and an outside wall of the connecting pipe.

7 Claims, 4 Drawing Sheets

INTAKE PASSAGE DEVICE FOR AN INTERNAL COMBUSTION ENGINE

BACKGROUND OF THE INVENTION

The present invention relates to an intake passage device for an internal combustion engine.

A small agricultural machine such as a portable trimmer and a shoulder spray may be used in an inclined position. In such a machine, it is necessary that the internal combustion engine mounted on the machine operates normally even if the machine is tilted.

In general, the internal combustion engine is manufactured by molding of aluminum alloy, so that the intake passage of the engine is tapered toward the intake port of the cylinder because of the draft of the mold. As a result, the speed of the mixture flowing from the carburetor to the intake port is reduced, which may cause particles of the fuel in the mixture to drop and stick on the inside wall of the intake passage.

Japanese Utility Model Publication 3-2698 discloses a device for removing the above described problem. In the device, a connecting pipe having a constant inside passage is connected between the carburetor and the intake port, thereby forming an intake passage having a constant inner diameter over the entire length of the passage. The inner end of the connecting pipe is engaged with an inside wall of a cylindrical projection of the intake port.

However, the inside wall of the cylindrical projection has a rough surface because of the molding without grinding. Therefore, liquefied fuel is liable to enter the space between the outer wall of the connecting pipe and the rough surface and to be accumulated therein. If the accumulated fuel discharges from the space due to the position of the engine and enters the combustion chamber of the engine, the combustion condition in the chamber may be affected to discharge incomplete combustion gases, causing air pollution.

SUMMARY OF THE INVENTION

An object of the present invention is to provide an intake passage device which may prevent the liquefied fuel from accumulating in the space between the connecting pipe and the cylindrical projection of the intake port of the cylinder of the engine.

According to the present invention, there is provided an intake passage device for an internal combustion engine having carburetor communicated with a connecting projection of an intake port of a cylinder of the engine, the device comprising, a connecting pipe communicating the carburetor with the intake port, an inner end of the connecting pipe being engaged in the connecting projection, at least one communication passage formed at a lower portion of the connecting pipe for communicating an inside of the connecting pipe with a space between an inside wall of the connecting projection and an outside wall of the connecting pipe.

The communication passage is in the form of slit in an axial direction of the connecting pipe.

In another aspect, the communication passage is in the form of cylindrical hole in a radial direction of the connecting pipe.

In still further aspect, the communication passage is in the form of a cylindrical hole in a radial direction and inclined toward the cylinder.

The device further comprises a pulse intake hole formed in an intake pipe of the carburetor for applying negative pressure pulses to a diaphragm chamber of a fuel pump.

These and other objects and features of the present invention will become more apparent from the following detailed description with reference to the accompanying drawings.

DETAILED DESCRIPTION OF THE PREFERRED EMBODIMENT

Figure 1:
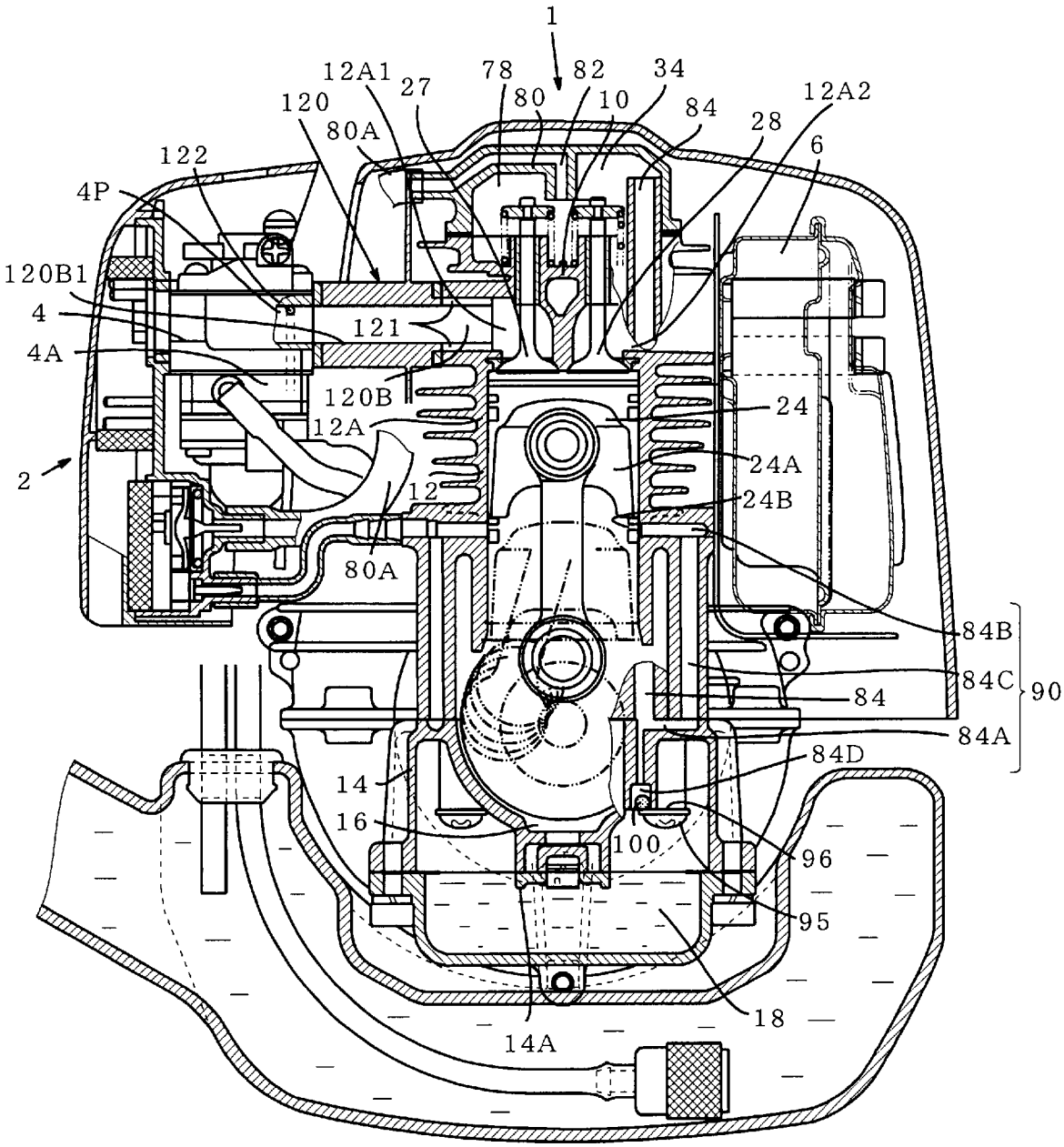
FIG. 1 is a sectional view of a four-cycle engine provided with an intake passage device of the present invention taken along a line perpendicular to the crankshaft of the engine.
Figure 2:
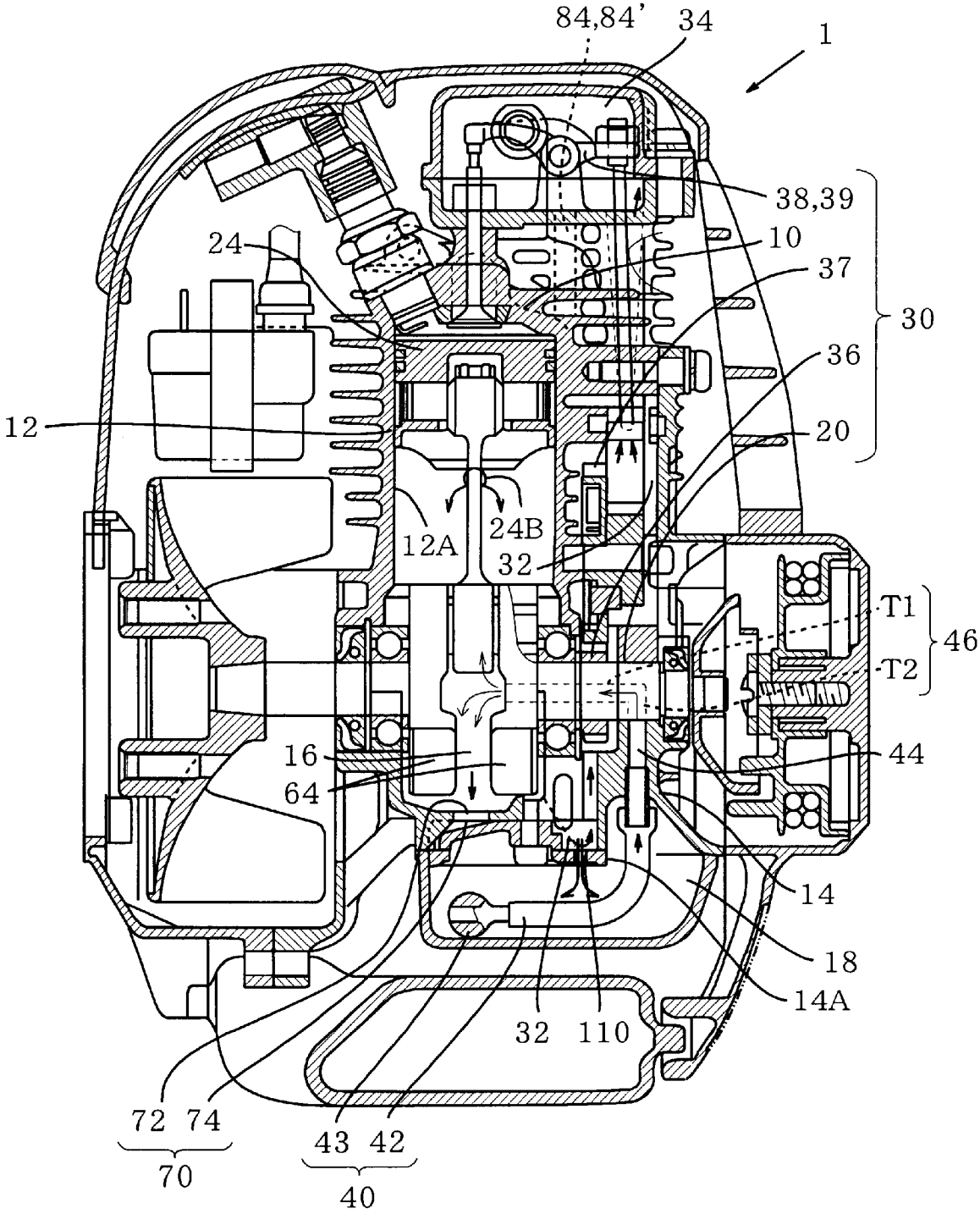
FIG. 2 is a sectional view of the engine taken along a line passing the crankshaft.

Referring to FIGS. 1 and 2, an engine 1 has an air cleaner 2, carburetor 4, and exhaust muffler 6. The engine body comprises a cylinder block 12, cylinder head 10, crankcase 14, crank chamber 16, and oil chamber 18. The oil chamber 18 is separated from the crankcase 14 by a partition 14A.

As shown in FIG. 2, a crankshaft 20 is rotatably mounted in the crankcase. A piston 24 connected to the crankshaft is slidably engaged in a cylinder 12A.

Referring to FIG. 1, an intake port 12A1 and an exhaust port 12A2 are formed in the cylinder 12 at an upper portion thereof to be communicated with the carburetor 4 and the exhaust muffler 6, and an intake valve 27 and an exhaust valve 28 are provided in corresponding ports.

As shown in FIG. 2, a valve mechanism 30 comprises a valve driving gear 36, cam gear 37, and rocker arms 38 and 39.

The valve driving gear 36 and cam gear 37 are disposed in a passage 32 communicating a valve chamber 34 with the crank chamber 16.

A suction portion 40, passage 44 and intermittent oil feeding portion 46 formed in the crankshaft 20 are provided between the crank chamber 16 and oil chamber 18 as a first oil feeder.

The suction portion 40 is composed by a flexible pipe 42 and a weight 43. Therefore, if the engine is tilted, the weight 43 is kept in the oil in the oil chamber 18. The other end of the pipe 42 is connected to the passage 44 the other end of which is opened onto the crankshaft 20.

The intermittent oil feeder 46 in the crankshaft 20 comprises an axis passage T1 and a radial passage T2. The passage T2 is adapted to be communicated with the passage 44 in the crankcase 14 at a predetermined angular position of the crankshaft where the crank chamber 16 becomes negative pressure.

Therefore, when the crank chamber 16 becomes negative pressure at the upward stroke of the piston 24, the oil in the oil chamber 18 is sucked at the weight 43 and fed to the crank chamber 16 passing through the pipe 42, passages 44, T2 and T1.

The crankshaft 20 is provided with crank webs 64 for agitating the oil in the crank chamber 16.

A one-way valve 70 is provided between the crank chamber 16 and the oil chamber 18 as a second oil feeder. The one-way valve 70 comprises valve passage 72 and a valve plate 74 which is closed when the crank chamber becomes negative pressure.

Referring to FIG. 1, a breezer pipe 80 is provided in an upper portion of the cylinder block 12. The breezer pipe 80 is communicated with the valve chamber 34 by an opening 82 at one of the ends, and with the air cleaner 2 at the other end.

In the valve chamber 34, oil return passage 84 is formed, one end thereof is opened to the valve chamber 34, and the other end is communicated with the oil chamber 18 by a passage 84'.

When the crank chamber 16 becomes negative pressure at the upward stroke of the piston 24, and the passage T2 communicates with the passage 44, the oil in the oil chamber 18 is fed to the crank chamber 16 passing through the intermittent oil feeder 46. The oil fed to the crank chamber is agitated by the crank webs 64 to be scattered, so that the oil becomes oil mist. The oil mist lubricates necessary portions in the crank chamber 16.

When the crank chamber 16 becomes positive pressure at the downward stroke of the piston 24, the valve plate 74 of the one-way valve 70 is opened. Thus, the oil mist in the crank chamber is fed from an opening 110 to the passage 32 passing through the oil chamber 18. The oil mist is further fed to the valve chamber 34 to lubricate respective parts of the valve mechanism 30. The oil mist is divided into the oil and air in the valve chamber 34. The separated oil is returned to the oil chamber passing through the return passages 84 and 84'. On the other hand, the separated air is discharged to the air cleaner 2 passing through the opening 82, breezer pipe 80 and pipe 80A.

In the case that the engine is inverted or tilted, the weight 43 moves to the position where the oil in the oil chamber 18 is held. Consequently, the oil is sucked and fed to necessary portions by the negative pressure in the crank chamber 16 in the same manner as the engine in the normal position.

Referring to FIG. 1, there is provided a bypass suction passage 90 in parallel with the return passage 84. The suction passage 90 comprises a branch passage 84A branched from the return passage 84, bypass passage 84C, and passage 84B having an opening 24B at a position under a skirt 24A of the piston 24 at the top dead center. Therefore, when the piston is at the top dead center, the passage 84B communicates with the inside of the cylinder 12A.

On the other hand, at an opening 84D of the return passage 84 to be opened to the oil chamber 18, a non-return valve 100 is provided. The non-return valve has a ball held by a plate 96 secured to the underside of the crankcase 14 by a bolt 95.

In operation, when the crank chamber 16 is at negative pressure at the upward stroke of the piston 24, the oil in the oil chamber 18 is fed to the crank chamber 16 passing through the suction portion 40 and the intermittent oil feeder 46 as described hereinbefore.

When the piston reaches the top dead center, the oil in the valve chamber 34 is fed to the inside of the cylinder 12A passing through the return passage 84 and suction passage 90, thereby lubricating respective parts in the cylinder 12A.

When the crank chamber 16 is at positive pressure at the downward stroke, the valve plate 74 of the one-way valve 70 is opened, the fuel mist caused by the crank webs 64 is fed to valve mechanism 30 and the valve chamber 34 passing through the opening 110 and the passage 32. Since the diameter of the opening 110 is small, the fuel mist is prevented from excessively supplying to the valve mechanism 30 and valve chamber 34.

In the condition where the engine is in inverted position or tilted, the oil in the oil chamber 18 is blocked by the non-return valve 100, thereby preventing the reverse flow of the oil.

The embodiment of the present invention is applied to such an engine operative even if the engine is inverted.

Figure 3:
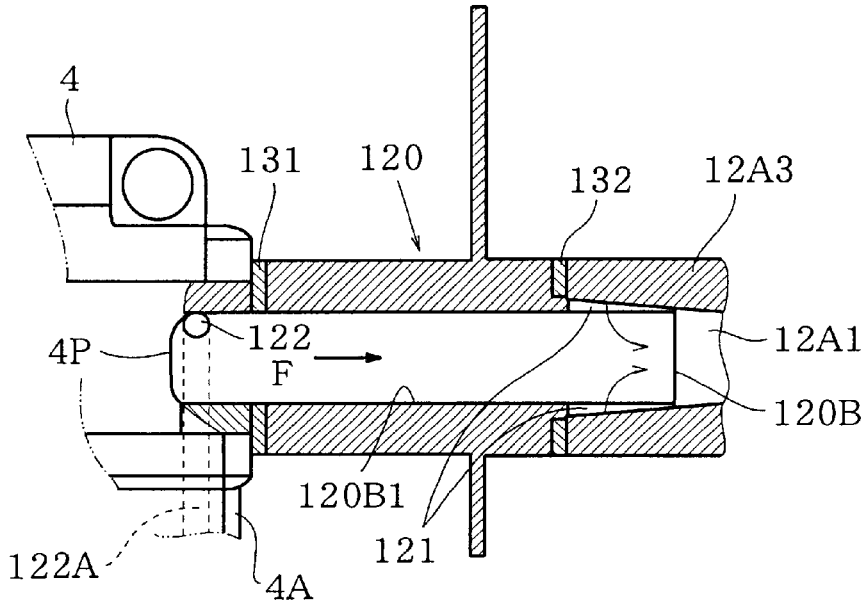
FIG. 3 is a sectional view of the intake passage device.

As shown in FIG. 3, a connecting pipe 120 made of insulator is provided between the carburetor 4 and the intake port 12A1 of the cylinder 12A, interposing seals 131 and 132. The base end of the connecting pipe 120 is secured to the carburetor 4 by bolts (not shown), the other end has an engaging pipe 120B having a smaller outer diameter than that of the body of the connecting pipe 120. The engaging pipe 120B is inserted into a cylindrical connecting projection 12A3 of the intake port 12A1. Since the inner diameter of the connecting projection 12A3 becomes smaller toward the inside of the intake port, the outer diameter of the engaging pipe 120B becomes smaller toward the inside accordingly. In other words, the engaging pipe 120B is tapered. Thus, the connecting pipe 120 has an intake passage 120B1 of a constant inner diameter.

There is formed a plurality of axial communication passages 121 in the engaging pipe 120B. Each of the passages 121 is in the form of a slit and communicates the space between the inside wall of the connecting projection 12A3 with the intake passage 120B1. The passages 121 are formed at least at a lowermost position and an uppermost position as shown in FIG. 3.

In an intake pipe 4P of the carburetor 4, a pulse intake hole 122 is formed at an uppermost position for introducing negative pressure pulses in the intake passage 120B1 based on the engine operation. The hole 122 is communicated with a diaphragm chamber 4A of a fuel pump by a passage 122A. The diaphragm of the fuel pump is vibrated by the negative pressure, thereby feeding the fuel to carburetor 4. The fuel pump is disposed on the underside of the carburetor. Therefore, particular piping is not necessary.

Since the space between the inside wall of the connecting projection 12A3 is communicated with the intake passage 120B1 by the communication passages, the liquefied fuel accumulated in the space is discharged in the intake passage 120B1 by the negative pressure caused by the fuel mixture flowing in the direction of the arrow F.

Since the pulse intake hole 122 is positioned at the uppermost position, the liquefied fuel accumulated in a lower portion of the connecting pipe 120 is not sucked in the hole.

Figure 4:
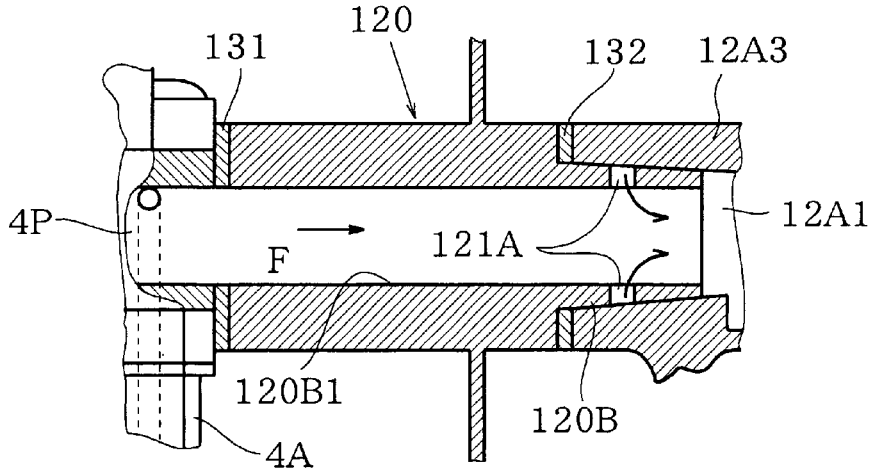
FIG. 4 is a sectional view of a modification of the intake passage device.

Referring to FIG. 4 showing the modification of the connecting pipe 120, there is formed a plurality of communication passages 121A each of which is in the form of a cylindrical hole in the radial direction.

Figure 5:
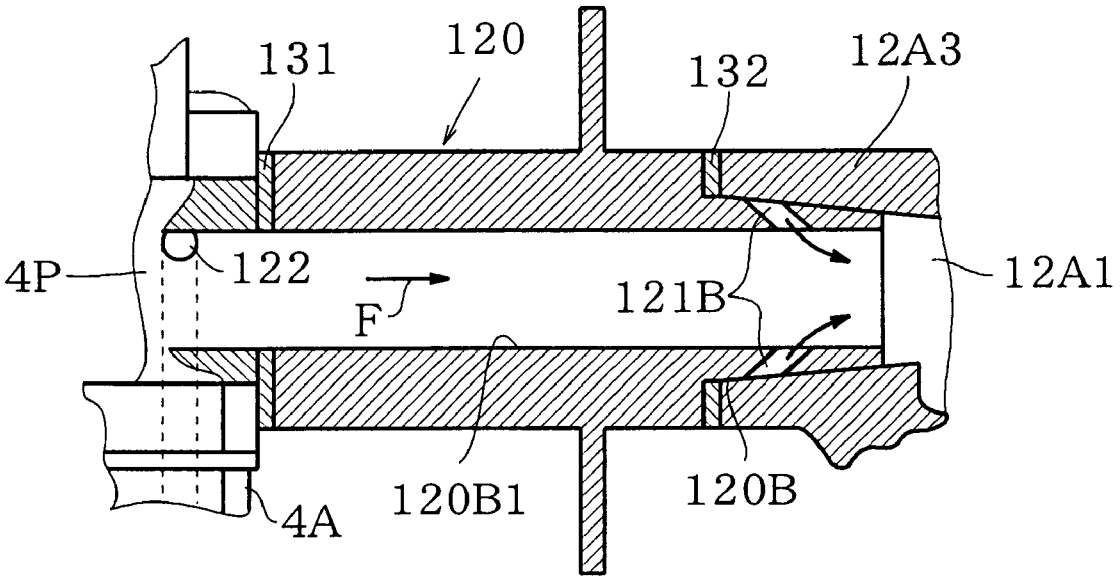
FIG. 5 is a sectional view showing another modification of the device.

In the modification of FIG. 5, there is formed a plurality of communication passages 121B each of which is in the form of a cylindrical hole in the radial direction and inclined toward the cylinder 12A. Therefore, the liquefied fuel is easily discharged in the intake passage 120B1 due to the inclination of the communication passage.

In accordance with the present invention, the space between the inside wall of the connecting projection 12A3 is communicated with the intake passage 120B1 by the communication passages. Therefore, the liquefied fuel accumulated in the space is discharged in the intake passage by the negative pressure in the intake passage. Thus, the combustion condition is not affected, thereby preventing the air pollution.

While the invention has been described in conjunction with preferred specific embodiment thereof, it will be understood that this description is intended to illustrate and not limit the scope of the invention, which is defined by the following claims.

What is claimed is:

1. An intake passage device for an internal combustion engine having a carburetor communicated with a connecting projection of an intake port of a cylinder of the engine, wherein the diameter of the connecting projection becomes smaller toward the inside of the intake port, the device comprising:

a connecting pipe communicating the carburetor with the intake port, an inner end of the connecting pipe being inserted into the connecting projection;

at least one communication passage formed at a lower portion of the connecting pipe for communicating an inside of the connecting pipe with a space between an inside wall of the connecting projection and an outside wall of the connecting pipe.

2. The device according to claim 1 wherein the communication passage is in the form of slit in an axial direction of the connecting pipe.

3. The device according to claim 1 wherein the communication passage is in the form of cylindrical hole in a radial direction of the connecting pipe.

4. The device according to claim 1 wherein the communication passage is in the form of a cylindrical hole in a radial direction and inclined toward the cylinder.

5. The device according to claim 1 further comprising a pulse intake hole formed in an intake pipe of the carburetor for applying negative pressure pulses to a diaphragm chamber of a fuel pump.

6. The device according to claim 5 wherein the pulse intake hole is formed at an upper portion of the intake pipe.

7. The device according to claim 1 wherein the engine is a four-cycle engine which is operated regardless of the position of the engine.

* * * * *